US008794726B2

(12) United States Patent
Hiyoshi et al.

(10) Patent No.: US 8,794,726 B2
(45) Date of Patent: Aug. 5, 2014

(54) INKJET HEAD DRIVING DEVICE

(71) Applicant: Toshiba Tec Kabushiki Kaisha, Tokyo (JP)

(72) Inventors: Teruyuki Hiyoshi, Izunokuni (JP); Noboru Nitta, Tagata-gun (JP); Mamoru Kimura; Tomohisa Yoshimaru, Yokohama (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/768,162

(22) Filed: Feb. 15, 2013

(65) Prior Publication Data

US 2014/0049574 A1 Feb. 20, 2014

(30) Foreign Application Priority Data

Mar. 26, 2012 (JP) ..... 2012-070310

(51) Int. Cl.
*B41J 29/38* (2006.01)
*B41J 2/045* (2006.01)
*B41J 2/14* (2006.01)

(52) U.S. Cl.
CPC ..... *B41J 2/04541* (2013.01); *B41J 2/0455* (2013.01); *B41J 2002/14491* (2013.01); *B41J 2/14072* (2013.01); *B41J 2/14201* (2013.01)
USPC ..... 347/10

(58) Field of Classification Search
CPC .. B41J 2/04541; B41J 2/0455; B41J 2/04588; B41J 2/14072; B41J 2/14201
USPC ..... 347/5, 9–11, 50, 57–59, 68
See application file for complete search history.

(56) References Cited

U.S. PATENT DOCUMENTS

| | | | | |
|---|---|---|---|---|
| 4,714,935 | A | 12/1987 | Yamamoto et al. | |
| 6,841,920 | B2 | 1/2005 | Takamura et al. | |
| 7,559,626 | B2 * | 7/2009 | Sakurai et al. | 347/50 |
| 8,371,668 | B2 * | 2/2013 | Kasai et al. | 347/5 |
| 8,540,348 | B2 * | 9/2013 | Benjamin | 347/59 |

FOREIGN PATENT DOCUMENTS

JP 2002-094364 3/2002

* cited by examiner

*Primary Examiner* — An Do
(74) *Attorney, Agent, or Firm* — Amin, Turocy & Watson, LLP

(57) ABSTRACT

According to one embodiment, an inkjet head driving device includes a load-voltage generating circuit and a plurality of channel driving circuits provided to respectively correspond to a plurality of channels of an inkjet head. The load-voltage generating circuit selects any one voltage out of a reference voltage and a driving voltage having potential other than the reference voltage and outputs the voltage. Each of the channel driving circuits includes a first input terminal, a second input terminal, a third input terminal, an output terminal, a series circuit, and a parallel circuit.

14 Claims, 9 Drawing Sheets

INKJET HEAD DRIVING DEVICE

CROSS-REFERENCE TO RELATED APPLICATIONS

This application is based upon and claims the benefit of priority from Japanese Patent Application No. 2012-070310, filed on Mar. 26, 2012, the entire contents of which are incorporated herein by reference.

FIELD

Embodiments described herein relate generally to an inkjet head driving device used in an inkjet recording apparatus or the like.

BACKGROUND

There is already known a technique capable of setting a driving voltage higher by suppressing a peak value of an induced voltage generated in an electrode. However, in this technique, a pair of a low-impedance switching element and a high-impedance switching element is arranged between a driving power supply and the electrode. Further, in this technique, for each of the switching elements, a pre-buffer for driving the switching element and a level shifter for driving the pre-buffer are necessary.

In the case of a multichannel inkjet head, a channel driving circuit including the switching elements, pre-buffers, and level shifters is necessary for each of channels. Therefore, when circuit integration of a driving device in which channel driving circuits are integrated is considered, there is a concern that an IC is increased in size, causing an increase in costs of the IC.

DETAILED DESCRIPTION

In general, according to one embodiment, an inkjet head driving device includes a load-voltage generating circuit and a plurality of channel driving circuits provided to respectively correspond to a plurality of channels of an inkjet head.

The load-voltage generating circuit selects any one voltage out of a reference voltage and a driving voltage having potential other than the reference voltage and outputs the voltage.

Each of the channel driving circuits includes a first input terminal, a second input terminal, a third input terminal, an output terminal, a series circuit, and a parallel circuit. The driving voltage is applied to the first input terminal. The reference voltage is applied to the second input terminal. The voltage output from the load-voltage generating circuit is applied to the third input terminal. The reference voltage or the driving voltage is output from the output terminal to the channel corresponding to the output terminal. In the series circuit, a first switching element and a second switching element are connected in series between the first input terminal and the second input terminal and a connection point of the first switching element and the second switching element is connected to the output terminal. In the parallel circuit, a third switching element and a fourth switching element are connected in parallel between the third input terminal and the output terminal.

Explanation of an Inkjet Head

First, an inkjet head 1 used in an embodiment is explained with reference to FIGS. 9 to 13.

Figure 9:
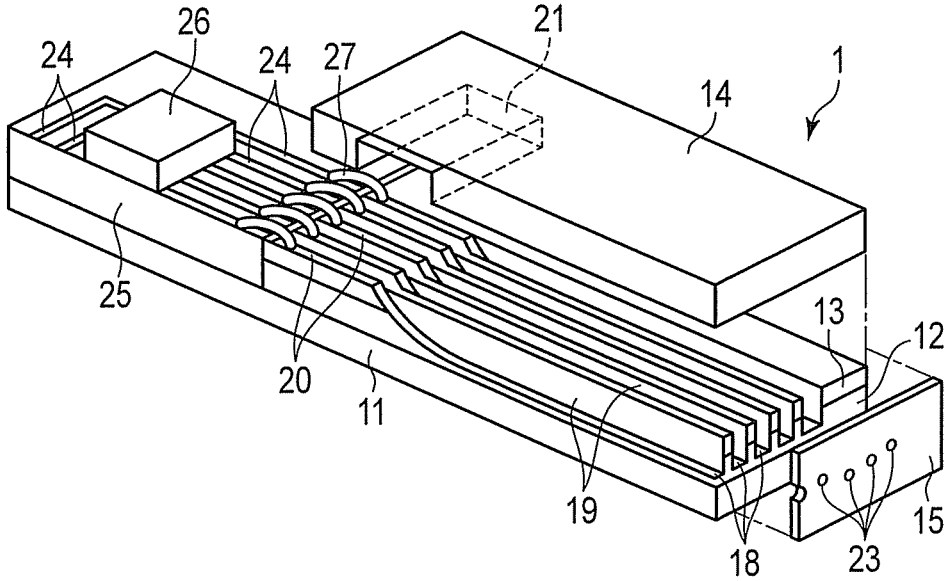
FIG. 9 is an exploded perspective view of a part of an inkjet head.
Figure 10:
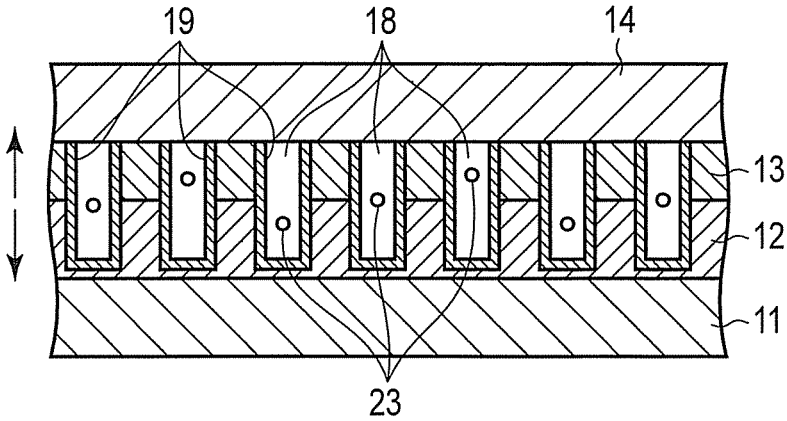
FIG. 10 is a cross sectional view in a front portion of the inkjet head.
Figure 11:
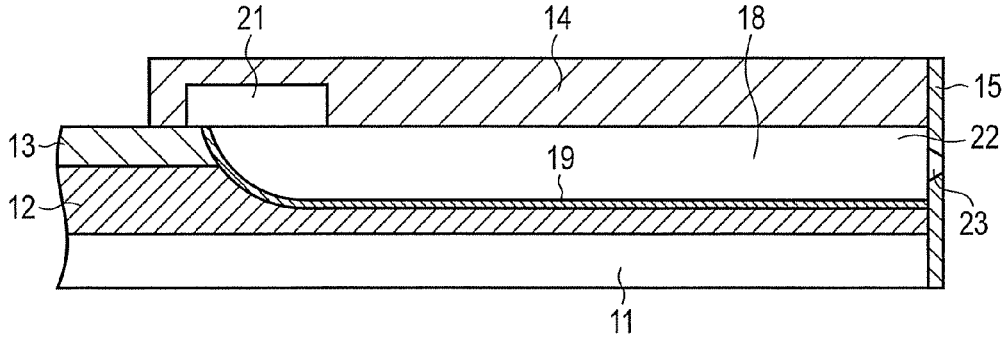
FIG. 11 is a longitudinal sectional view in the front portion of the inkjet head.

FIGS. 9 to 11 are main part structure diagrams of the inkjet head 1. FIG. 9 is an exploded perspective view of a part of the inkjet head 1. FIG. 10 is a cross sectional view in a front portion of the inkjet head 1. FIG. 11 is a longitudinal sectional view in the front portion of the inkjet head 1.

In the inkjet head 1, a first piezoelectric member 12 is joined to the upper surface on the front side of a base substrate 11. A second piezoelectric member 13 is joined on the first piezoelectric member 12. The first piezoelectric member 12 and the second piezoelectric member 13 joined together are polarized in directions opposite to each other along a plate thickness direction as indicated by an arrow in FIG. 10.

In the inkjet head 1, a large number of elongated grooves 18 are provided from the front end side to the rear end side of the joined piezoelectric members 12 and 13. The grooves 18 are provided at a fixed interval and parallel to one another. The front ends of the grooves 18 are opened and the rear ends of the grooves 18 are inclined upward.

In the inkjet head 1, electrodes 19 are provided on partition walls and bottom surfaces of the grooves 18. Further, in the inkjet head 1, extraction electrodes 20 extended from the electrodes 19 to extend from the rear ends of the grooves 18 toward the rear part upper surface of the second piezoelectric member 13 are provided.

In the inkjet head 1, the upper portions of the grooves 18 are closed by a top plate 14 and the front ends of the grooves 18 are closed by an orifice plate 15. The top plate 14 includes a common ink chamber 21 in a rear part on the inner side thereof.

In the inkjet head 1, a plurality of ink chambers 22 are formed by the grooves 18 surrounded by the top plate 14 and the orifice plate 15. In the inkjet head 1, nozzles 23 for performing ejection of ink are opened in positions of the orifice plate 15 opposed to the grooves 18. The nozzles 23 communicate with the ink chambers 22 opposed thereto.

In the inkjet head 1, a printed board 25 on which conductor patterns 24 are formed is joined to the upper surface on the rear side of the base substrate 11. In the inkjet head 1, a drive IC 26 mounted with an inkjet head driving device 30 explained below (see FIG. 1) is mounted on the printed board 25. The drive IC 26 is connected to the conductor patterns 24.

The conductor patterns 24 are bonded to the extraction electrodes 20 by wire bonding using lead wires 27.

Figure 12A:
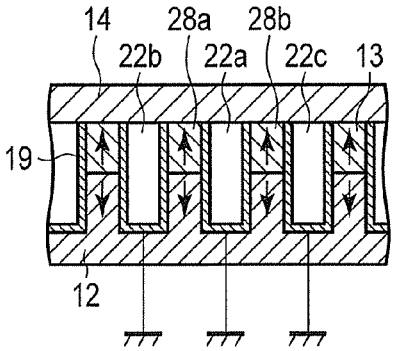
FIGS. 12A, 12B and 12C are schematic diagrams used for explanation of an operation principle of the inkjet head.
Figure 12B:
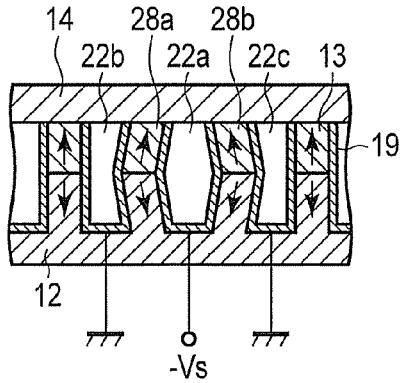
Figure 12C:
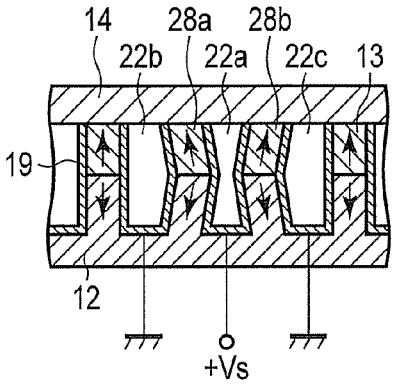

FIGS. 12A to 12C are schematic diagrams used for explanation of an operation principle of the inkjet head 1.

FIG. 12A shows a state in which all the electrodes 19 of an ink chamber 22*a* in the center and ink chambers 22*b* and 22*c* adjacent to and on both sides of the ink chamber 22*a* are at ground potential. In this state, partition walls 28*a* and 28*b* formed by the piezoelectric members 12 and 13 and respectively provided between the ink chamber 22*a* and the ink chamber 22*b* and between the ink chamber 22*a* and the ink chamber 22*c* are not subjected to straining.

FIG. 12B shows a state in which a negative voltage (−Vs) is applied to the electrode 19 of the ink chamber 22*a* in the center. Both the electrodes 19 of the ink chambers 22*b* and 22*c* on both the sides are at the ground potential. In this state, an electric field acts on the partition walls 28*a* and 28*b* in a direction orthogonal to a polarizing direction of the piezoelectric members 12 and 13. According to this action, the partition walls 28*a* and 28*b* are respectively deformed to the outer sides to expand the volume of the ink chamber 22*a*.

FIG. 12C shows a state in which a positive voltage (+Vs) is applied to the electrode 19 of the ink chamber 22*a* in the center. Both the electrodes 19 of the ink chambers 22*b* and 22*c* on both the sides are at the ground potential. In this state, an electric field acts on the partition walls 28*a* and 28*b* in a direction orthogonal to the polarizing direction of the piezoelectric members 12 and 13 and in a direction opposite to the direction in FIG. 12B. According to this action, the partition walls 28*a* and 28*b* are respectively deformed to the inner sides to reduce the volume of the ink chamber 22*a*.

Figure 13:
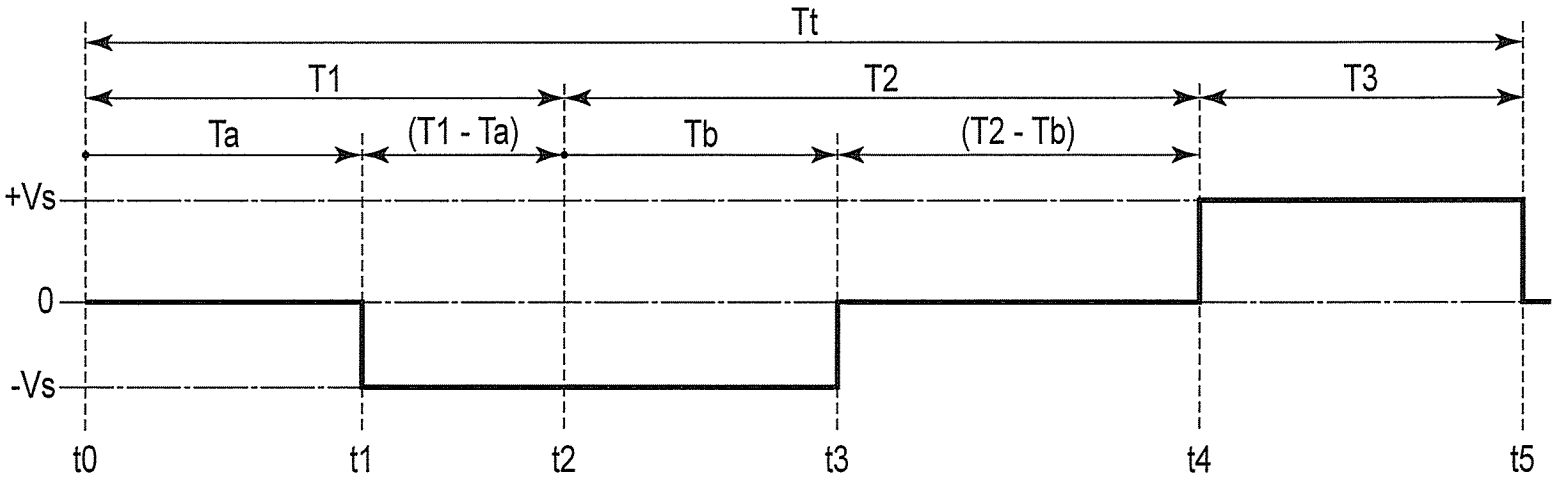
FIG. 13 is an energization waveform chart of a driving pulse signal applied to the inkjet head.

FIG. 13 is an energization waveform chart of a driving pulse signal DP applied to the electrode 19 of the ink chamber 22*a* in order to eject ink droplets from the ink chamber 22*a* in the center. A section indicated by time Tt is time necessary for ejection of one drop of an ink droplet. This time is referred to as one-drop period Tt. The one-drop period Tt is divided into time T1 in a preparation section, time T2 in an ejection section, and time T3 in a post processing section. The preparation time T1 is divided into time Ta in a regular section and time (T1−Ta) in an extended section. The time T2 in the ejection section is divided into time Tb in a maintenance section and time (T2−Tb) in a restoration section. The preparation time T1, the ejection time T2, and the post processing time T3 are set to appropriate values according to conditions such as ink to be used and temperature.

As shown in FIG. 13, first, at point t0, the inkjet head driving device 30 applies a 0-volt reference voltage to each of the electrodes 19 corresponding to the ink chambers 22*a*, 22*b*, and 22*c*. The inkjet head driving device 30 stands by for the regular time Ta to elapse. During the standby, the ink chambers 22*a*, 22*b*, and 22*c* are in the state shown in FIG. 12A.

At point t1 after the elapse of the regular time Ta, the inkjet head driving device 30 applies a predetermined negative voltage (−Vs) to the electrode 19 corresponding to the ink chamber 22*a* as a driving voltage. The inkjet head driving device 30 stands by for the preparation time T1 to elapse. When the negative voltage (−Vs) is applied, the partition walls 28*a* and 28*b* on both the sides of the ink chamber 22*a* are respectively deformed to the outer sides to expand the volume of the ink chamber 22*a* and change to the state shown in FIG. 12B. According to the deformation, the pressure in the ink chamber 22*a* decreases. Therefore, the ink flows into the ink chamber 22*a* from the common ink chamber 21.

At point t2 after the elapse of the preparation time T1, the inkjet head driving device 30 continues to apply the negative voltage (−Vs) to the electrode 19 corresponding to the ink chamber 22*a* until the maintenance time Tb elapses. During the application of the negative voltage, the ink chambers 22*a*, 22*b*, and 22*c* maintain the state shown in FIG. 12B.

At point t3 after the elapse of the maintenance time Tb, the inkjet head driving device 30 resets the voltage applied to the electrode 19 corresponding to the ink chamber 22*a* to the 0-volt reference voltage. The inkjet head driving device 30 stands by for the ejection time T2 to elapse. When the applied voltage is reset to 0 volt, the partition walls 28*a* and 28*b* on both the sides of the ink chamber 22*a* are restored to the regular state to return to the state shown in FIG. 12A. According to the restoration, the pressure in the ink chamber 22*a* increases. Therefore, the ink droplets are ejected from the nozzle 23 corresponding to the ink chamber 22*a*.

At point t4 after the elapse of the ejection time T2, the inkjet head driving device 30 applies a predetermined positive voltage (+Vs) to the electrode 19 corresponding to the ink chamber 22*a* as a driving voltage. The inkjet head driving device 30 stands by for the post processing time T3 to elapse. When the positive voltage (+Vs) is applied, the partition walls 28*a* and 28*b* on both the side of the ink chamber 22*a* are respectively deformed to the inner sides to reduce the volume of the ink chamber 22*a* and change to the state shown in FIG. 12C. According to the deformation, the pressure in the ink chamber 22*a* further increases. Therefore, a sudden voltage drop that occurs in the ink chamber 22*a* because of the ejection of the ink droplets is relaxed.

At point t5 after the elapse of the post processing time T3, the inkjet head driving device 30 resets the voltage applied to the electrode 19 corresponding to the ink chamber 22*a* to the O-volt reference voltage again. According to the reset of the applied voltage to 0 volt, the partition walls 28*a* and 28*b* on both the sides of the ink chamber 22*a* are restored to the regular state. In other words, the ink chambers 22*a*, 22*b*, and 22*c* return to the state shown in FIG. 12A.

The inkjet head driving device 30 supplies the driving pulse signal DP having the energization waveform shown in FIG. 13 to the electrode 19 of the ink chamber 22*a* in the center. Then, one drop of an ink droplet is ejected from the nozzle 23 corresponding to the ink chamber 22*a*.

First Embodiment

A first embodiment of the inkjet head driving device 30 is explained with reference to FIGS. 1 to 4. In this embodiment, an inkjet head driving device 30A adapted to two kinds of power supplies, i.e., a VAA power supply and GND is illustrated. The inkjet head driving device 30A drives the inkjet head 1 in which the number of channels is n (ch.1 to ch.n: n>1). The channel indicates a channel of ink including a nozzle and an ink chamber that communicates with the nozzle.

Figure 1:
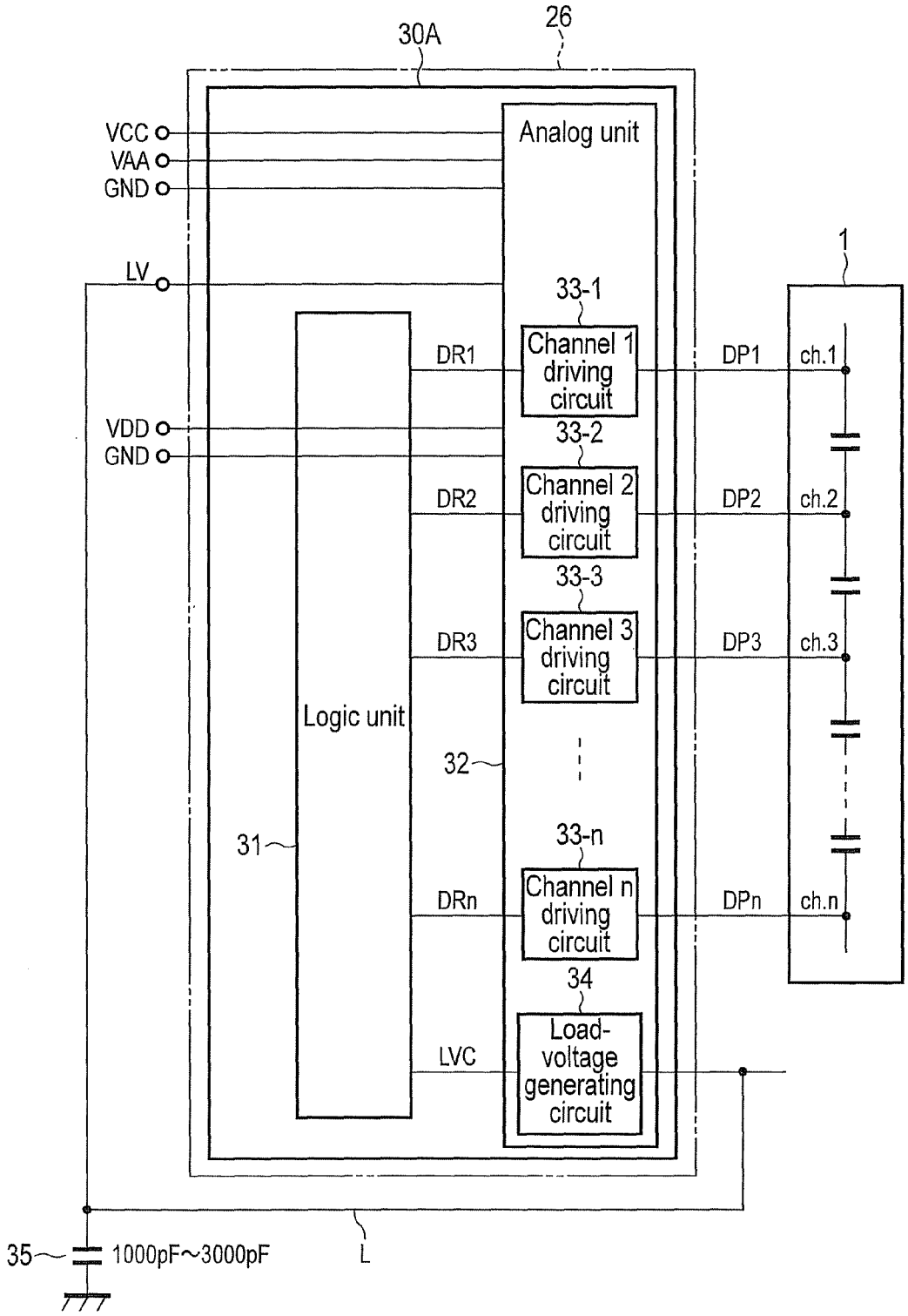
FIG. 1 is a schematic configuration diagram of an inkjet head driving device in a first embodiment.

FIG. 1 is a schematic configuration diagram of the inkjet head driving device 30A. The inkjet head driving device 30A mounted on the drive IC 26 includes a logic unit 31 and an analog unit 32.

The analog unit 32 includes n channel driving circuits 33-1 to 33-*n* and a load-voltage generating circuit 34. The channel driving circuits 33-1 to 33-*n* respectively correspond to the channels ch.1 to ch.n of the inkjet head 1.

A VCC terminal, a GND terminal, a VAA terminal, and a LV terminal are connected to the analog unit 32 as power supply terminals. A power supply for supplying a VCC voltage, i.e., a so-called VCC power supply is connected to the VCC terminal. The VCC power supply is a driving power supply for the channel driving circuits 33-1 to 33-*n*. The GND terminal is grounded to a GND (ground) level. A power supply for supplying a VAA voltage, i.e., a VAA power supply is connected to the VAA terminal. The VAA power supply is a power supply for generating driving pulse signals DP1 to DPn.

The channel driving circuits 33-1 to **33-*n* driven by the VCC power supply generate the driving pulse signals DP1 to DPn according to the VAA voltage, which is a driving voltage, and the GND level, which is a reference voltage. The driving pulse signals DP1 to DPn respectively generated for the channel driving circuits 33-1 to 33-*n* are supplied to the electrodes 19 of the ink chambers 22 that form the channels ch.1 to ch.n respectively corresponding to the channel driving circuits 33-1 to 33-*n*** and served for ejection of ink droplets.

Similarly, the load-voltage generating circuit 34 driven by the VCC power supply generates a predetermined load voltage LV. The load voltage LV is supplied to the LV terminal. A capacitor 35 having 1000 pF to 3000 pF is coupled to a power supply line L that connects a load voltage output terminal of the load-voltage generating circuit 34 and the LV terminal. The capacitor 35 is interposed between the power supply line L and the GND level. Output potential is stabilized by the capacitor 35.

A VDD terminal and a GND terminal are connected to the logic unit 31 as power supply terminals. A power supply for supplying a VDD terminal, i.e., a so-called VDD power supply is connected to the VDD terminal. The VDD power supply is a driving power supply for the logic unit 31. The GND terminal is grounded to the GND level.

The logic unit 31 driven by the VDD power supply generates driving signals DR1 to DRn for the respective channels ch.1 to ch.n and a load voltage control signal LVC on the basis of printing data and control parameters given from a not-shown printing control unit. The driving signals DR1 to DRn are output to the channel driving circuits 33-1 to **33-*n* corresponding thereto. The load voltage control signal LVC is output to the load-voltage generating circuit 34**.

Figure 2:
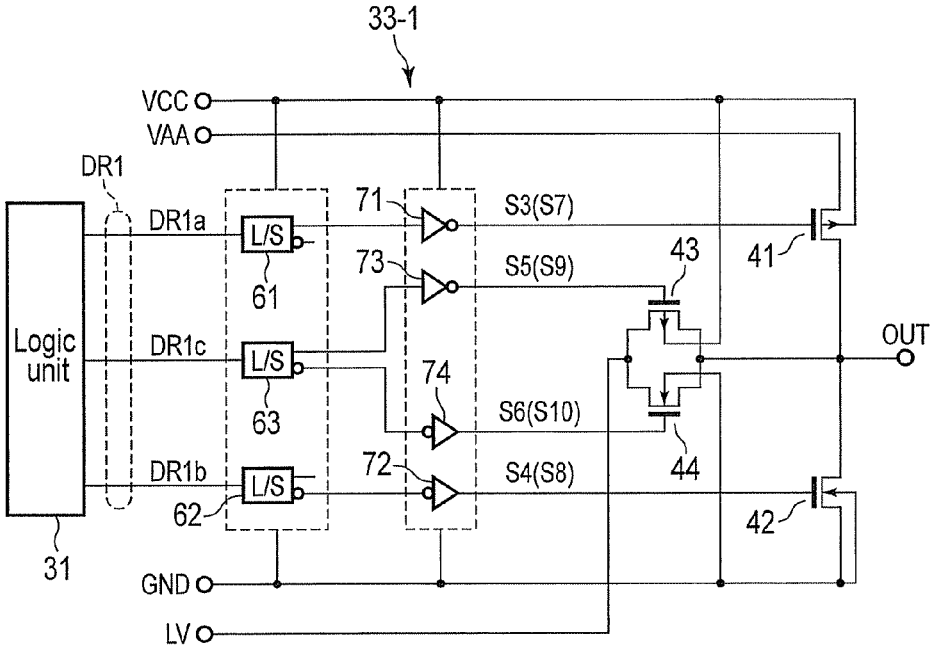
FIG. 2 is a configuration diagram of a channel driving circuit included in the inkjet head driving device.

FIG. 2 is a configuration diagram of the channel driving circuit 33-1. The other channel driving circuits 33-2 to **33-*n* have the same configuration as the channel driving circuit 33-1. Therefore, explanation of the other channel driving circuits 33-2 to 33-*n*** is omitted.

The channel driving circuit 33-1 includes the VCC terminal, the VAA terminal (a first input terminal), the GND terminal (a second input terminal), and the LV terminal (a third input terminal) as input terminals and includes an OUT terminal as an output terminal.

The electrode 19 of the channel ch.1 of the inkjet head 1 corresponding to the OUT terminal is connected to the OUT terminal. The driving pulse signal DP1 is output to the electrode 19 from the OUT terminal.

In the channel driving circuit 33-1, a series circuit of a low-impedance PMOS transistor (a first switching element) 41 and a low-impedance NMOS transistor (a second switching element) 42 is connected between the VAA terminal and the GND terminal with the PMOS transistor 41 set on the VAA terminal side. A connection point of the PMOS transistor 41 and the NMOS transistor 42 is connected to the OUT terminal.

In the channel driving circuit 33-1, a parallel circuit of a high-impedance PMOS transistor 43 (a third switching element) and a high-impedance NMOS transistor 44 (a fourth switching element) is connected between the LV terminal and the OUT terminal.

The driving signal DR1 of the channel ch.1 is divided into driving signals DR1*a*, DR1*b*, and DR1*c* of three systems and input to the channel driving circuit 33-1 from the logic unit 31.

The driving signal DR1*a* of the first system is input to a first level shifter 61. The first level shifter 61 converts the driving signal DR1*a* into a high voltage. The driving signal DR1*a* of a positive logic after being converted into the high voltage is input to a first pre-buffer 71. The first pre-buffer 71 inverts the level of the driving signal DR1*a* of the positive logic. The driving signal DR1*a* after being level-inverted is supplied to a gate of the PMOS transistor 41.

The driving signal DR1*b* of the second system is input to a second level shifter 62. The second level shifter 62 converts the driving signal DR1*b* into a high voltage. A driving signal /DR1*b* of a negative logic after being converted into the high voltage is input to a second pre-buffer 72. The second pre-buffer 72 inverts the level of the driving signal /DR1*b* of the negative logic. The driving signal /DR1*b* after being level-inverted is supplied to a gate of the NMOS transistor 42.

The driving signal DR1*c* of the third system is input to a third level shifter 63. The third level shifter 63 converts the driving signal DR1*c* into a high voltage. The driving signal DR1*c* of a positive logic after being converted into the high voltage is input to a third pre-buffer 73. The third pre-buffer 73 inverts the level of the driving signal DR1*c* of the positive logic. The driving signal DR1*c* after being level-inverted is supplied to a gate of the PMOS transistor 43.

A driving signal /DR1*c* of the negative logic after being converted into the high voltage by the third level shifter 63 is input to a fourth pre-buffer 74. The fourth pre-buffer 74 inverts the level of the driving signal /DR1*c* of the negative logic. The driving signal /DR1*c* after being level-inverted is supplied to a gate of the NMOS transistor 44.

The first to third level shifters 61 to 63 and the first to fourth pre-buffers 71 to 74 are driven by the VCC power supply.

Figure 3:
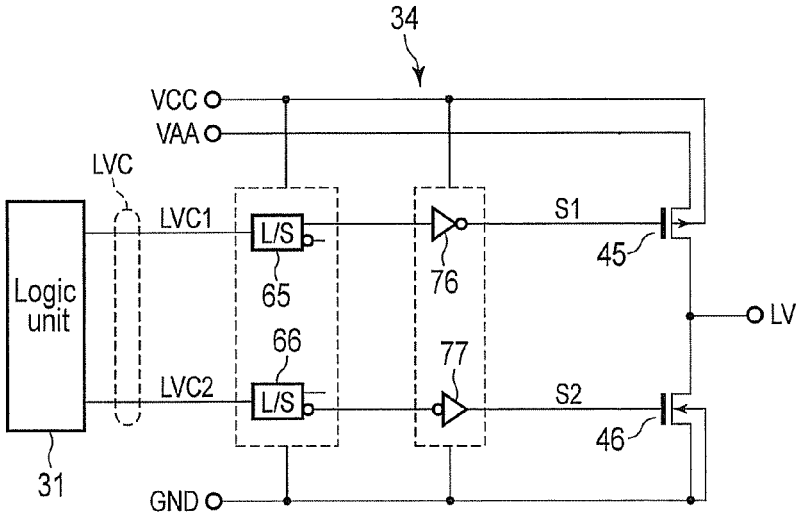
FIG. 3 is a configuration diagram of a load-voltage generating circuit included in the inkjet head driving device.

FIG. 3 is a configuration diagram of the load-voltage generating circuit 34. The load-voltage generating circuit 34 includes the VCC terminal, the VAA terminal, and the GND terminal as input terminals and includes an LV terminal as an output terminal. The LV terminal of the load-voltage generating circuit 34 is connected to LV terminals of the channel driving circuits 33-1 to **33-*n*** via the power supply line L.

In the load-voltage generating circuit 34, a series circuit of a low-impedance PMOS transistor 45 and a low-impedance NMOS transistor 46 is connected between the VAA terminal and the GND terminal with the PMOS transistor 45 set on the VAA terminal side.

The load voltage control signal LVC is divided into load voltage control signals LVC1 and LVC2 of two systems and input to the load-voltage generating circuit 34 from the logic unit 31.

The load voltage control signal LVC1 of the first system is input to a fifth level shifter 65. The fifth level shifter 65 converts the load voltage control signal LVC1 into a high voltage. The load voltage control signal LVC1 of a positive logic after being converted into the high voltage is input to a sixth pre-buffer 76. The sixth pre-buffer 76 inverts the level of the load voltage control signal LVC1 of the positive logic. The load voltage control signal LVC1 after being level-inverted is supplied to a gate of the PMOS transistor 45.

The load voltage control signal LVC2 of the second system is input to a sixth level shifter 66. The sixth level shifter 66 converts the load voltage control signal LVC2 into a high voltage. A load voltage control signal /LVC2 of a negative logic after being converted into the high voltage is input to a seventh pre-buffer 77. The seventh pre-buffer 77 inverts the level of the load voltage control signal /LVC2 of the negative logic. The load voltage control signal /LVC2 after being level-inverted is supplied to a gate of the NMOS transistor 46.

The fifth and sixth level shifters 65 and 66 and the sixth and seventh pre-buffers 76 and 77 are driven by the VCC power supply.

Figure 4:
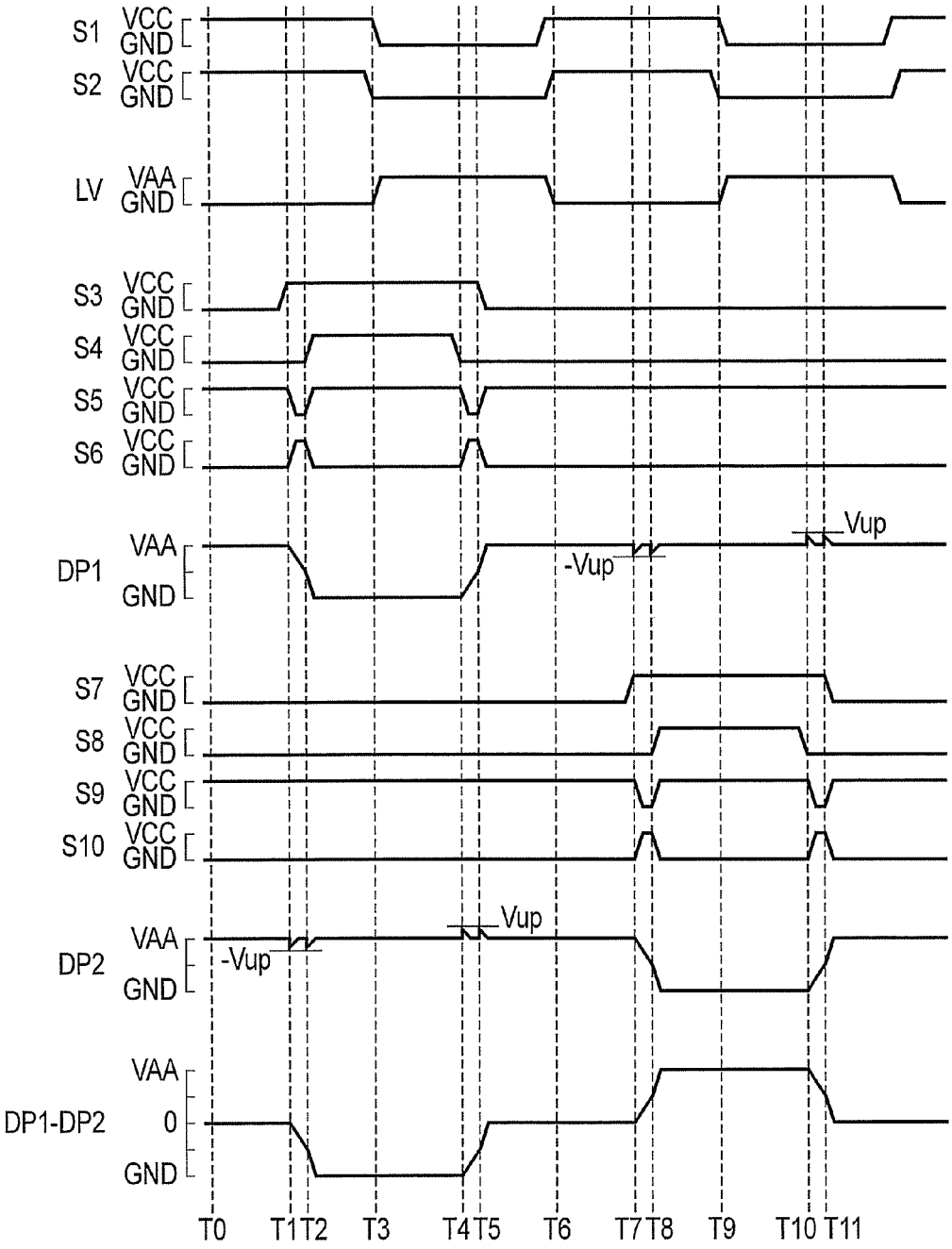
FIG. 4 is a timing chart of main signals in the inkjet head driving device.

FIG. 4 is a timing chart of main signals in the inkjet head driving device 30A. In FIG. 4, a signal S1, a signal S2, and a signal LV are signals related to the load-voltage generating circuit 34. A signal S3, a signal S4, a signal S5, a signal S6, and a signal DP1 are signals related to the channel driving circuit 33-1 corresponding to the channel ch.1. A signal S7, a signal S8, a signal S9, a signal S10, and a signal DP2 are signals related to the channel driving circuit 33-2 corresponding to the channel ch.2 adjacent to the channel ch.1.

Specifically, the signal S1 is supplied to the gate of the PMOS transistor 45 via the sixth pre-buffer 76 of the load-voltage generating circuit 34. The second signal S2 is supplied to the gate of the NMOS transistor 46 via the seventh pre-buffer 77 of the load-voltage generating circuit 34. The signal LV is output from the LV terminal of the load-voltage generating circuit 34.

The signal S3 is supplied to the gate of the PMOS transistor 41 via the first pre-buffer 71 of the channel driving circuit 33-1. The signal S4 is supplied to the gate of the NMOS transistor 42 via the second pre-buffer 72 of the channel driving circuit 33-1. The signal S5 is supplied to the gate of the PMOS transistor 43 via the third pre-buffer 73 of the channel driving circuit 33-1. The signal S6 is supplied to the gate of the NMOS transistor 44 via the fourth pre-buffer 74 of the channel driving circuit 33-1. The signal DP1 is supplied from the OUT terminal of the channel driving circuit 33-1 to the electrode 19 of the ink chamber 22 that forms the channel ch.1 of the inkjet head 1.

The signal S7 is supplied to the gate of the PMOS transistor 41 via the first pre-buffer 71 of the channel driving circuit 33-2. The signal S8 is supplied to the gate of the NMOS transistor 42 via the second pre-buffer 72 of the channel driving circuit 33-2. The signal S9 is supplied to the gate of the PMOS transistor 43 via the third pre-buffer 73 of the channel driving circuit 33-2. The signal S10 is supplied to the gate of the NMOS transistor 44 via the fourth pre-buffer 74 of the channel driving circuit 33-2. The signal DP2 is supplied from the OUT terminal of the channel driving circuit 33-2 to the electrode 19 of the ink chamber 22 that forms the channel ch.2 of the inkjet head 1.

A signal [DP1−DP2] is a difference signal of the signal DP1 and the signal DP2. A waveform of the difference signal is a waveform of a voltage applied to capacitive elements provided between the electrode 19 of the channel ch.1 and the electrode 19 of the channel ch.2 of the inkjet head 1, i.e., the partition walls 28*a* and 28*b* formed by the piezoelectric members 12 and 13.

The PMOS transistors 41, 43, and 45 are turned on when the signals supplied to the gates thereof are at the GND level. The NMOS transistors 42, 44, and 46 are turned on when the signals supplied to the gates thereof are at the VCC voltage level. Therefore, in an initial state at point T0 in FIG. 4, in the load-voltage generating circuit 34, the PMOS transistor 45 is turned off and the NMOS transistor 46 is turned on. Therefore, the signal LV changes to the GND level.

On the other hand, in the channel driving circuit 33-1, the PMOS transistor 41 is turned on and all the other NMOS transistor 42, PMOS transistor 43, and NMOS transistor 44 are turned off. Therefore, the signal DP1 changes to the VAA voltage level. Similarly, in the channel driving circuit 33-2, the PMOS transistor 41 is turned on and all the other NMOS transistor 42, PMOS transistor 43, and NMOS transistor 44 are turned off. Therefore, the signal DP2 changes to the VAA voltage level. As a result, the difference signal [DP1−DP2] is at the zero "0" level.

At the next point T1, the logic unit 31 outputs the driving signal DR1 for turning on both the high-impedance PMOS transistor 43 and the high-impedance NMOS transistor 44 of the channel driving circuit 33-1. According to the driving signal DR1, in the channel driving circuit 33-1, the PMOS transistor 41 is turned off and the PMOS transistor 43 and the NMOS transistor 44 are turned on. As a result, the channel driving circuit 33-1 selects the signal LV at the GND level. Therefore, the potential of the output signal DP1 starts to drop.

At point T2 after the elapse of a predetermined time from point T1, the logic unit 31 outputs the driving signal DR1 for turning on the low-impedance NMOS transistor 42 of the channel driving circuit 33-1. According to the driving signal DR1, in the channel driving circuit 33-1, both of the PMOS transistor 43 and the NMOS transistor 44 are turned off and the NMOS transistor 42 is turned on. As a result, in the channel driving circuit 33-1, the potential of the output signal DP1 drops to the GND level. Consequently, the partition walls 28*a* and 28*b* of the ink chamber 22 are respectively deformed to the outer sides to expand the volume of the ink chamber 22. The ink is filled in the ink chamber 22.

An induced voltage −Vup in a minus direction is generated in the electrode 19 on the channel ch.2 side twice at point T1 and point T2. At point T1, the PMOS transistor 43 and the NMOS transistor 44 are turned on. At point T2, the NMOS transistor 42 is turned on.

At this point, in this embodiment, first, the high-impedance PMOS transistor 43 and the high-impedance NMOS transistor 44 are turned on. Then, after the elapse of the predetermined time, the low-impedance NMOS transistor 42 is turned on. Therefore, a peak value of the induced voltage −Vup is suppressed.

At point T3, the logic unit 31 outputs the control signal LVC for turning on the PMOS transistor 45 of the load-voltage generating circuit 34. According to the control signal LVC, in the load-voltage generating circuit 34, the PMOS transistor 45 is turned on and the NMOS transistor 46 is turned off. As a result, the signal LV changes to the VAA voltage level.

At point T4, the logic unit 31 outputs the driving signal DR1 for turning on both of the high-impedance PMOS transistor 43 and the high-impedance NMOS transistor 44 of the channel driving circuit 33-1. According to the driving signal DR1, in the channel driving circuit 33-1, the NMOS transistor 42 is turned off and the PMOS transistor 43 and the NMOS transistor 44 are turned on. As a result, the channel driving circuit 33-1 selects the signal LV at the VAA voltage level. Therefore, the potential of the output signal DP1 of the channel driving circuit 33-1 starts to rise.

At point T5 after the elapse of a predetermined time from the point T4, the logic unit 31 outputs the driving signal DR1 for turning on the low-impedance PMOS transistor 41 of the channel driving circuit 33-1. According to the driving signal DR1, in the channel driving circuit 33-1, the PMOS transistor 43 and the NMOS transistor 44 are turned off and the PMOS transistor 41 is turned on. As a result, in the channel driving circuit 33-1, the potential of the output signal DP1 returns to the VAA voltage level. Consequently, the ink chamber 22 of the channel ch.1 filled with the ink is restored to the regular state. Ink droplets are ejected from the nozzle 23 corresponding to the ink chamber 22.

An induced voltage Vup in a plus direction is generated in the electrode 19 on the channel ch.2 side twice at point T4 and point T5. At point T4, the PMOS transistor 43 and the NMOS transistor 44 are turned on. At point T5, the PMOS transistor 41 is turned on.

At this point, in this embodiment, first, the high-impedance PMOS transistor 43 and the high-impedance NMOS transistor 44 are turned on. After the elapse of the predetermined time, the low-impedance PMOS transistor 41 is turned on. Therefore, a peak value of the induced voltage Vup is suppressed.

At point T6, the logic unit 31 outputs the control signal LVC for turning on the NMOS transistor 46 of the load-voltage generating circuit 34. According to the control signal LVC, in the load-voltage generating circuit 34, the PMOS transistor 45 is turned off and the NMOS transistor 46 is turned on. As a result, the signal LV changes to the GND level.

At point T7, the logic unit 31 outputs the driving signal DR2 for turning on both the high-impedance PMOS transistor 43 and the high-impedance NMOS transistor 44 of the channel driving circuit 33-2. According to the driving signal DR2, in the channel driving circuit 33-2, the PMOS transistor 41 is turned off and the PMOS transistor 43 and the NMOS transistor 44 are turned on. As a result, the channel driving circuit 33-2 selects the signal LV at the GND level. Therefore, the potential of the output signal DP2 starts to drop.

At point T8 after the elapse of a predetermined time from point T7, the logic unit 31 outputs the driving signal DR2 for turning on the low-impedance NMOS transistor 42 of the channel driving circuit 33-2. According to the driving signal DR2, in the channel driving circuit 33-2, both of the PMOS transistor 43 and the NMOS transistor 44 are turned off and the NMOS transistor 42 is turned on. As a result, in the channel driving circuit 33-2, the potential of the output signal DP2 drops to the GND level. Consequently, the volume of the ink chamber 22 of the channel ch.1 from which the ink droplets are ejected is reduced. A sudden voltage drop that occurs in the ink chamber 22 because of the ejection of the ink droplets is relaxed.

The induced voltage −Vup in the minus direction is generated in the electrode 19 on the channel ch.1 side twice at point T7 and point T8. At point T7, the PMOS transistor 43 and the NMOS transistor 44 are turned on. At point T8, the NMOS transistor 42 is turned on.

At this point, in this embodiment, first, the high-impedance PMOS transistor 43 and the high-impedance NMOS transistor 44 are turned on. Then, after the elapse of the predetermined time, the low-impedance NMOS transistor 42 is turned on. Therefore, the peak value of the induced voltage −Vup is suppressed.

At point T9, the logic unit 31 outputs the control signal LVC for turning on the PMOS transistor 45 of the load-voltage generating circuit 34. According to the control signal LVC, in the load-voltage generating circuit 34, the PMOS transistor 45 is turned on and the NMOS transistor 46 is turned off. As a result, the signal LV changes to the VAA voltage level.

At point T10, the logic unit 31 outputs again the driving signal DR2 for turning on both of the high-impedance PMOS transistor 43 and the high-impedance NMOS transistor 44 of the channel driving circuit 33-2. According to the driving signal DR2, in the channel driving circuit 33-2, the NMOS transistor 42 is turned off and the PMOS transistor 43 and the NMOS transistor 44 are turned on again. As a result, the channel driving circuit 33-2 selects the signal LV at the VAA voltage level. Therefore, the potential of the output signal DP2 of the channel driving circuit 33-2 starts to rise.

At point T11 after the elapse of a predetermined time from point T10, the logic unit 31 outputs—the driving signal DR2 for turning on the low-impedance PMOS transistor 41 of the channel driving circuit 33-2. According to the driving signal DR2, in the channel driving circuit 33-2, the PMOS transistor 43 and the NMOS transistor 44 are turned off and the PMOS transistor 41 is turned on again. As a result, in the channel driving circuit 33-2, the potential of the output signal DP2 returns to the VAA voltage level. Consequently, the ink chamber 22 once reduced in volume is restored to the regular state.

The induced voltage Vup in the plus direction is generated in the electrode 19 on the channel ch.1 side twice at point T10 and point T11. At point T10, the PMOS transistor 43 and the NMOS transistor 44 are turned on. At point T11, the PMOS transistor 41 is turned on.

At this point, in this embodiment, first, the high-impedance PMOS transistor 43 and the high-impedance NMOS transistor 44 are turned on. Then, after the elapse of the predetermined time, the low-impedance PMOS transistor 41 is turned on. Therefore, the peak value of the induced voltage Vup can be suppressed.

As explained above, with the inkjet head driving device 30A in this embodiment, the peak value of the induced voltage Vup (−Vup) generated in the electrode 19 of a channel adjacent to an ejection channel can be suppressed. Therefore, it is possible to set the driving voltage higher. As a result, a setting range of the driving voltage is expanded. The reliability of the inkjet head 1 is improved.

In the channel driving circuit in the past, for each of MOS transistors forming a switching element, a pre-buffer for driving the MOS transistor and a level shifter for driving the pre-buffer are necessary. On the other hand, in the channel driving circuits 33-1 to **33-*n* in this embodiment, as shown in FIG. 2, only the three level shifters 61, 62, and 63 are necessary for the four MOS transistors 41, 42, 43, and 44. Therefore, when compared in the channel driving circuits 33-1 to 33-*n*** for n channels, n level shifters can be saved in the circuit in this embodiment compared with the circuit in the past.

On the other hand, in this embodiment, the load-voltage generating circuit 34 is added to the analog unit 32 anew. In the load-voltage generating circuit 34, as shown in FIG. 3, the two MOS transistors 45 and 46, the two pre-buffers 76 and 77, and the two level shifters 65 and 66 are necessary. However, only one load-voltage generating circuit 34 is necessary irrespective of the number of channels n of the inkjet head 1. Therefore, in a driving device for the inkjet head 1 in which the number of channels n is 7 or more, it is possible to further reduce the number of circuit components in this embodiment than in the related art.

Usually, the number of channels n of the inkjet head 1 is sufficiently larger than 7. Therefore, according to this embodiment, it is possible to substantially reduce the number of circuit components included in the inkjet head driving device 30A. As a result, when circuit integration of the inkjet head driving device 30A is considered, it is possible to reduce the size and reduce costs of an IC.

Second Embodiment

A second embodiment of the inkjet head driving device 30 is explained with reference to FIGS. 5 to 8. In this embodiment, as a driving device for the inkjet head 1 same as that driving device in the first embodiment, an inkjet head driving device 30B adapted to three kinds of driving power supplies, i.e., a VAAP power supply, a VAAN power supply, and GND is illustrated. Incidentally, the VAAP power supply is a power supply for driving a PMOS transistor. The VAAN power supply is a power supply for driving an NMOS transistor. There is a relation "VAAP voltage>GND level>VANN voltage".

Figure 5:
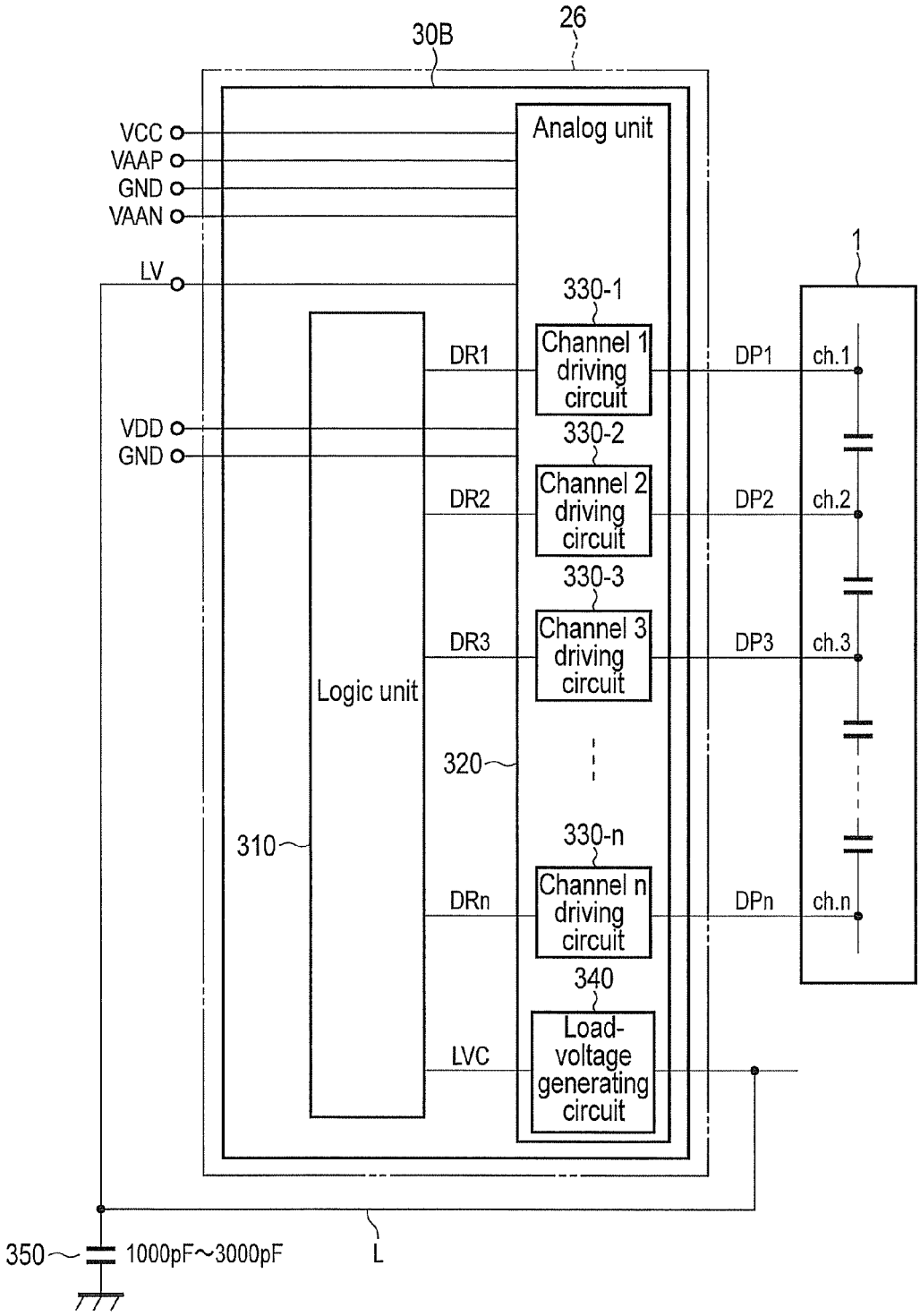
FIG. 5 is a schematic configuration diagram of an inkjet head driving device in a second embodiment.

FIG. 5 is a schematic configuration diagram of the inkjet head driving device 30B. The inkjet head driving device 30B mounted on the drive IC 26 includes a logic unit 310 and an analog unit 320. The logic unit 310 is the same as the logic unit 31 in the first embodiment. Therefore, explanation of the logic unit 310 is omitted.

The analog unit 320 includes n channel driving circuits 330-1 to **330-*n* provided to respectively correspond to the channels ch.1 to ch.n of the inkjet head 1 and a load-voltage generating circuit 340. A VCC terminal, a VAAP terminal, a GND terminal, a VAAN terminal, and an LV terminal are connected to the analog unit 320 as power supply terminals. A power supply for supplying a VCC voltage, i.e., a so-called VCC power supply is connected to the VCC terminal. The VCC power supply is a power supply for the channel driving circuits 330-1 to 330-*n*. A power supply for supplying a VAAP voltage, i.e., a so-called VAAP power supply is connected to the VAAP terminal. The VAAP power supply is a power supply for generating the driving pulse signals DP1 to DPn. A power supply for supplying a VAAN voltage, i.e., a so-called VAAN power supply is connected to the VAAN terminal. Like the VAAP power supply, the VAAN power supply is a power supply for generating the driving pulse signals DP1** to DPn. The GND terminal is grounded to the GND level.

The channel driving circuits 330-1 to **330-*n* driven by the VCC power supply generate the driving pulse signals DP1 to DPn according to the VAAP voltage and the VAAN voltage, which are driving voltages, and the GND level, which is a reference voltage. The driving pulse signals DP1 to DPn respectively generated for the channel driving circuits 330-1 to 330-*n* are supplied to the electrodes 19 of the ink chambers 22 that form the channels ch.1 to ch.n respectively corresponding to the channel driving circuits 330-1 to 330-*n*** and served for ejection of ink droplets.

Similarly, the load-voltage generating circuit 340 driven by the VCC power supply generates a predetermined load voltage LV. The load voltage LV is supplied to the LV terminal. The capacitor 35 having 1000 pF to 3000 pF is coupled to a power supply line L that connects a load voltage output terminal of the load-voltage generating circuit 340 and the LV terminal. The capacitor 35 is interposed between the power supply line L and the GND level. Output potential is stabilized by the capacitor 35.

Figure 6:
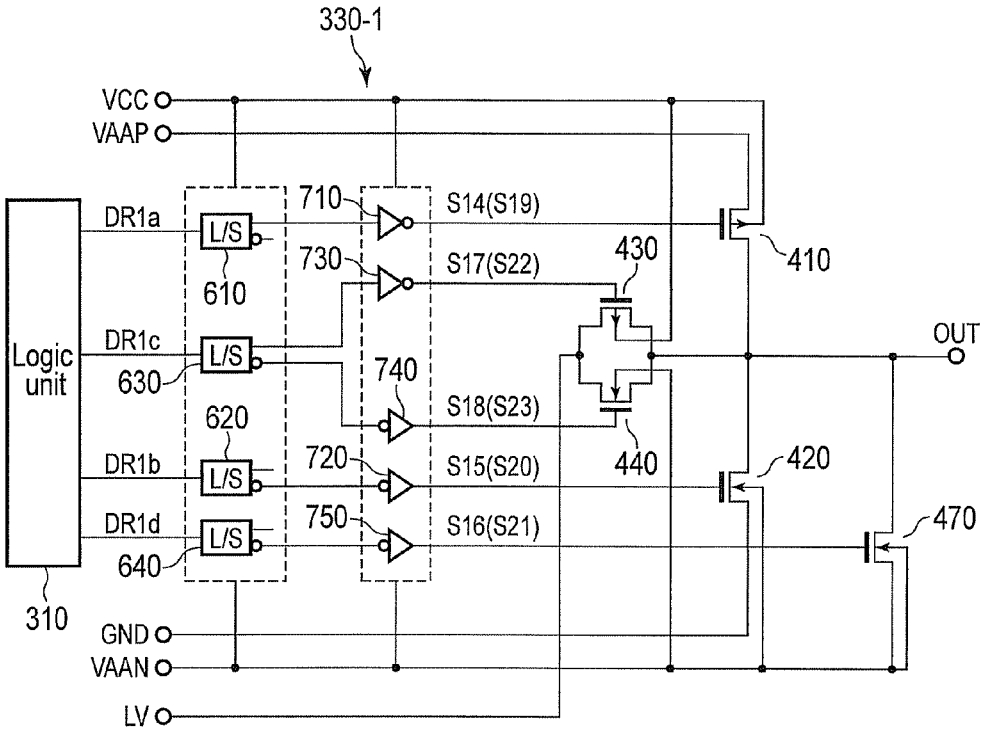
FIG. 6 is a configuration diagram of a channel driving circuit included in the inkjet head driving device.

FIG. 6 is a configuration diagram of the channel driving circuit 330-1. The other channel driving circuits 330-2 to **330-*n* have the same configuration as the channel driving circuit 330-1. Therefore, explanation of the other channel driving circuits 330-2 to 330-*n*** is omitted.

The channel driving circuit 330-1 includes the VCC terminal, the VAAP terminal (a first input terminal), the VAAN terminal (a fourth input terminal), the GND terminal (a second input terminal), and the LV terminal (a third input terminal) as input terminals and includes an OUT terminal as an output terminal. The electrode 19 of the channel ch.1 of the inkjet head 1 corresponding to the OUT terminal is connected to the OUT terminal. The driving pulse signal DP1 is output to the electrode 19 from the OUT terminal.

In the channel driving circuit 330-1, a first series circuit of a low-impedance PMOS transistor (a first switching element) 410 and a low-impedance NMOS transistor (a second switching element) 420 is connected between the VAAP terminal and the GND terminal with the PMOS transistor 410 set on the VAAP terminal side. A connection point of the PMOS transistor 410 and the NMOS transistor 420 is connected to the OUT terminal in the channel driving circuit 330-1.

In the channel driving circuit 330-1, a parallel circuit of a high-impedance PMOS transistor 430 (a third switching element) and a high-impedance NMOS transistor 440 (a fourth switching element) is connected between the LV terminal and the OUT terminal.

Further, in the channel driving circuit 330-1, a low-impedance NMOS transistor 470 (a fifth switching element) is connected between the OUT terminal and the VAAN terminal. Specifically, in the channel driving circuit 330-1, a second series circuit of the low-impedance NMOS transistor (the fifth switching element) 470 and the low-impedance NMOS transistor 420 (the second switching element) is connected between the VAAN terminal and the GND terminal with the NMOS transistor 470 set on the VAAN terminal side. In the driving circuit 330-1, a connection point of the NMOS transistor 470 and the NMOS transistor 420 is connected to the OUT terminal.

The driving signal DR1 of the channel ch.1 is divided into driving signals DR1*a*, DR1*b*, DR1*c*, and DR1*d* of four systems and input to the channel driving circuit 330-1 from the logic unit 310. The driving signal DR1*a* of the first system is input to a first level shifter 610. The first level shifter 610 converts the driving signal DR1*a* into a high voltage. The driving signal DR1*a* of a positive logic after being converted into the high voltage is input to a first pre-buffer 710. The first pre-buffer 710 inverts the level of the driving signal DR1*a* of the positive logic. The driving signal DR1*a* after being level-inverted is supplied to a gate of the PMOS transistor 410.

The driving signal DRb1 of the second system is input to a second level shifter 620. The second level shifter 620 converts the driving signal DR1*b* into a high voltage. A driving signal /DR1*c* of a negative logic after being converted into the high voltage is input to a second pre-buffer 720. The second pre-buffer 720 inverts the level of the driving signal /DR1*c* of the negative logic. The driving signal /DR1*c* after being level-inverted is supplied to a gate of the NMOS transistor 420.

The driving signal DR1*c* of the third system is input to a third level shifter 630. The third level shifter 630 converts the driving signal DR1*c* into a high voltage. The driving signal DR1*c* of the positive logic after being converted into the high voltage is input to a third pre-buffer 730. The third pre-buffer 730 inverts the level of the driving signal DR1*c* of the positive logic. The driving signal DR1*c* after being level-inverted is supplied to a gate of the PMOS transistor 430. A driving signal /DR1*c* of the negative logic after being converted into the high voltage by the third level shifter 630 is input to a fourth pre-buffer 740. The fourth pre-buffer 740 inverts the level of the driving signal /DR1*c* of the negative logic. The driving signal /DR1*c* after being level-inverted is supplied to a gate of the NMOS transistor 440.

The driving signal DR1*d* of the fourth system is input to a fourth level shifter 640. The fourth level shifter 640 converts the driving signal DR1*d* into a high voltage. A driving signal /DR1*d* of the negative logic after being converted into the high voltage is input to a fifth pre-buffer 750. The fifth pre-buffer 750 inverts the level of the driving signal /DR1*d* of the negative logic. The driving signal /DR1*d* after being level-inverted is supplied to a gate of the NMOS transistor 470.

The first to fourth level shifters 610, 620, 630, and 640 and the first to fifth pre-buffers 710, 720, 730, 740, and 750 are driven by the VCC power supply.

Figure 7:
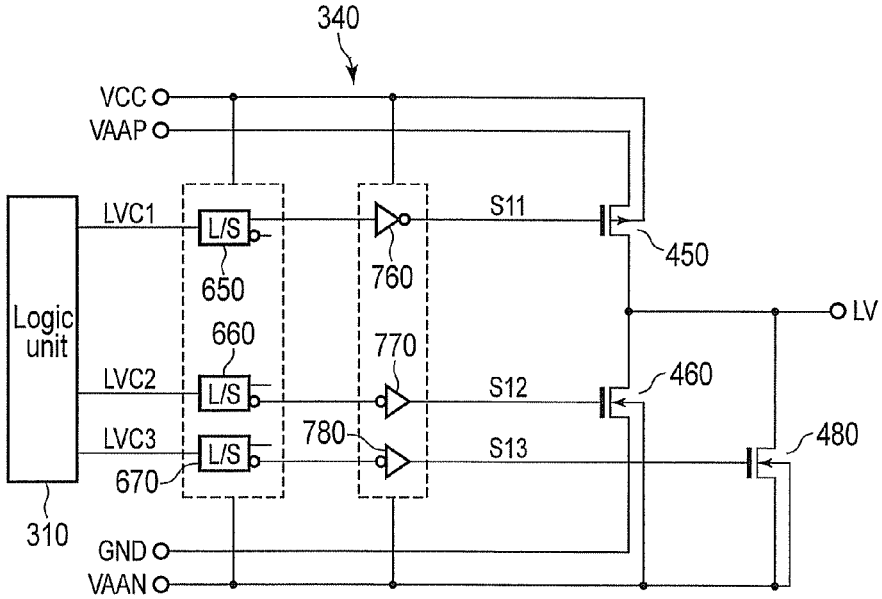
FIG. 7 is a configuration diagram of a load-voltage generating circuit included in the inkjet head driving device.

FIG. 7 is a configuration diagram of the load-voltage driving circuit 340. The load-voltage generating circuit 340 includes the VCC terminal, the VAAP terminal, the VAAN terminal, and the GND terminal as input terminals and includes an LV terminal as an output terminal. The LV terminal of the load-voltage generating circuit 340 is connected to LV terminals of the channel driving circuits 330-1 to **330-*n*** via the power supply line L.

In the load-voltage generating circuit 340, a series circuit of a low-impedance PMOS transistor 450 and a low-impedance NMOS transistor 460 is connected between the VAAP terminal and the GND terminal with the PMOS transistor 450 set on the VAAP terminal side.

In the load-voltage generating circuit 340, a low-impedance NMOS transistor 480 is connected between the LV terminal and the VAAN terminal.

The load voltage control signal LVC is divided into load voltage control signals LVC1, LVC2, and LVC3 of three systems and input to the load-voltage generating circuit 340 from the logic unit 310.

The load voltage control signal LVC1 of the first system is input to a fifth level shifter 650. The fifth level shifter 650 converts the load voltage control signal LVC1 into a high voltage. The load voltage control signal LVC1 of a positive logic after being converted into the high voltage is input to a sixth pre-buffer 760. The sixth pre-buffer 760 inverts the level of the load voltage control signal LVC1 of the positive logic. The load voltage control signal LVC1 after being level-inverted is supplied to a gate of the PMOS transistor 450.

The load voltage control signal LVC2 of the second system is input to a sixth level shifter 660. The sixth level shifter 660 converts the load voltage control signal LVC2 into a high voltage. A load voltage control signal /LVC2 of a negative logic after being converted into the high voltage is input to a seventh pre-buffer 770. The seventh pre-buffer 770 inverts the level of the load voltage control signal /LVC2 of the negative logic. The load voltage control signal /LVC2 after being level-inverted is supplied to a gate of the NMOS transistor 460.

The load voltage control signal LVC3 of the third system is input to a seventh level shifter 670. The seventh level shifter 670 converts the load voltage control signal LVC3 into a high voltage. The load voltage control signal /LVC3 of the negative logic after being converted into the high voltage is input to an eighth pre-buffer 780. The eighth pre-buffer 780 inverts the level of the load voltage control signal /LVC3 of the negative logic. The load voltage control signal /LVC3 after being level-inverted is supplied to a gate of the NMOS transistor 480.

The fifth to seventh level shifters 650, 660, and 670 and the sixth to eighth pre-buffers 760, 770, and 780 are driven by the VCC power supply.

Figure 8:
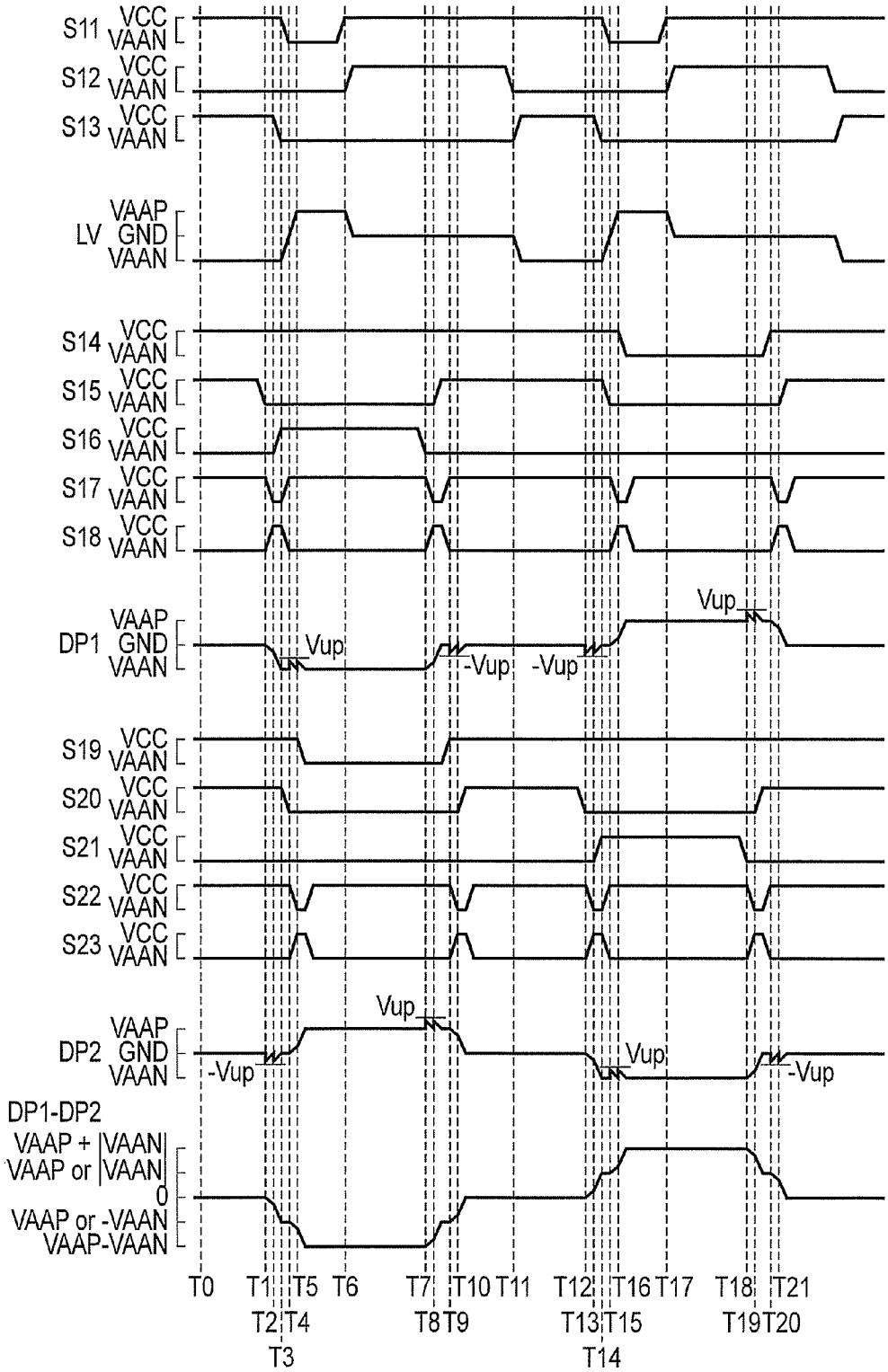
FIG. 8 is a timing chart of main signals in the inkjet head driving device.

FIG. 8 is a timing chart of main signals in the inkjet head driving device 30B. In FIG. 8, a signal S11, a signal S12, a signal S13, and a signal LV are signals related to the load-voltage generating circuit 340. A signal S14, a signal S15, a signal S16, a signal S17, a signal S18, and a signal DP1 are signals related to the channel driving circuit 330-1 corresponding to the channel ch.1. A signal S19, a signal S20, a signal S21, a signal S22, a signal S23, and a signal DP2 are signals related to the channel driving circuit 330-2 corresponding to the channel ch.2 adjacent to the channel ch.1.

Specifically, the signal 11 is supplied to the gate of the PMOS transistor 450 via the sixth pre-buffer 760 of the load-voltage generating circuit 340. The signal S12 is supplied to the gate of the NMOS transistor 460 via the seventh pre-buffer 770 of the load-voltage generating circuit 340. The signal S13 is supplied to the gate of the NMOS transistor 480 via the eight pre-buffer 780 of the load-voltage generating circuit 340. The signal LV is output from the LV terminal of the load-voltage generating circuit 340.

The signal S14 is supplied to the gate of the PMOS transistor 410 via the first pre-buffer 710 of the channel driving circuit 330-1. The signal S15 is supplied to the gate of the NMOS transistor 420 via the second pre-buffer 720 of the channel driving circuit 330-1. The signal S16 is supplied to the gate of the NMOS transistor 470 via the fifth pre-buffer 750 of the channel driving circuit 330-1. The signal S17 is supplied to the gate of the PMOS transistor 430 via the third pre-buffer 730 of the channel driving circuit 330-1. The signal S18 is supplied to the gate of the NMOS transistor 440 via the fourth pre-buffer 740 of the channel driving circuit 330-1. The signal DP1 is supplied from the OUT terminal of the channel driving circuit 330-1 to the electrode 19 of the ink chamber 22 that forms the channel ch.1 of the inkjet head 1.

The signal S19 is supplied to the gate of the PMOS transistor 410 via the first pre-buffer 710 of the channel driving circuit 330-2. The signal S20 is supplied to the gate of the NMOS transistor 420 via the second pre-buffer 720 of the channel driving circuit 330-2. The signal S21 is supplied to the gate of the NMOS transistor 470 via the fifth pre-buffer 750 of the channel driving circuit 330-2. The signal S22 is supplied to the gate of the PMOS transistor 430 via the third pre-buffer 730 of the channel driving circuit 330-2. The signal S23 is supplied to the gate of the NMOS transistor 440 via the fourth pre-buffer 740 of the channel driving circuit 330-2. The signal DP2 is supplied from the OUT terminal of the channel driving circuit 330-2 to the electrode 19 of the ink chamber 22 that forms the channel ch.2 of the inkjet head 1.

A signal [DP1−DP2] is a difference signal of the signal DP1 and the signal DP2. A waveform of the difference signal is a waveform of a voltage applied to capacitive elements provided between the electrode 19 of the channel ch.1 and the electrode 19 of the channel ch.2 of the inkjet head 1, i.e., the partition walls 28*a* and 28*b* formed by the piezoelectric members 12 and 13.

The PMOS transistors 410, 430, and 450 are turned on when the signals supplied to the gates thereof are at the VAAN voltage level. The NMOS transistors 420, 440, 460, 470, and 480 are turned on when the signals supplied to the gates thereof are at the VCC voltage level. Therefore, in an initial state at point T0 in FIG. 8, in the load-voltage generating circuit 340, the PMOS transistor 450 and the NMOS transistor 460 are turned off and the NMOS transistor 480 is turned on. Therefore, the signal LV is at the VAAN voltage level.

On the other hand, in the channel driving circuit 330-1, the NMOS transistor 420 is turned on and all the other PMOS transistor 410, PMOS transistor 430, NMOS transistor 440, and NMOS transistor 470 are turned off. Therefore, the signal DP1 is at the GND level. Similarly, in the channel driving circuit 330-2, the NMOS transistor 420 is turned on and all the other PMOS transistor 410, PMOS transistor 430, NMOS transistor 440, and NMOS transistor 470 are turned off. Therefore, the signal DP2 is at the GND level. As a result, the difference signal [DP1−DP2] is at the zero "0" level.

At the next point T1, the logic unit 310 outputs the driving signal DR1 for turning on both the high-impedance PMOS transistor 430 and the high-impedance NMOS transistor 440 of the channel driving circuit 330-1. According to the driving signal DR1, in the channel driving circuit 330-1, the NMOS transistor 420 is turned off and the PMOS transistor 430 and the NMOS transistor 440 are turned on. As a result, the channel driving circuit 330-1 selects the signal LV at the VAAN voltage level. Therefore, the potential of the output signal DP1 starts to drop.

At point T2 after the elapse of a predetermined time from point T1, the logic unit 310 outputs the driving signal DR1 for turning on the low-impedance NMOS transistor 470 of the channel driving circuit 330-1. According to the driving signal DR1, in the channel driving circuit 330-1, both of the PMOS transistor 430 and the NMOS transistor 440 are turned off and the NMOS transistor 470 is turned on. As a result, in the channel driving circuit 330-1, the potential of the output signal DP1 drops to the VAAN level.

At point T3, the logic unit 310 outputs the control signal LVC for turning on the PMOS transistor 450 of the load-voltage generating circuit 340. According to the control signal LVC, in the load-voltage generating circuit 340, the PMOS transistor 450 is turned on and the NMOS transistor 480 is turned off. As a result, the signal LV changes to the VAAP voltage level.

At point T4, the logic unit 310 outputs the driving signal DR2 for turning on both of the high-impedance PMOS transistor 430 and the high-impedance NMOS transistor 440 of the channel driving circuit 330-2. According to the driving signal DR2, in the channel driving circuit 330-2, the NMOS transistor 420 is turned off and the PMOS transistor 430 and the NMOS transistor 440 are turned on. As a result, the channel driving circuit 330-2 selects the signal LV at the VAAP voltage level. Therefore, the potential of the output signal DP2 starts to rise.

At point T5 after the elapse of a predetermined time from the point T4, the logic unit 310 outputs the driving signal DR2 for turning on the low-impedance PMOS transistor 410 of the channel driving circuit 330-2. According to the driving signal DR2, in the channel driving circuit 330-2, the PMOS transistor 430 and the NMOS transistor 440 are turned off and the PMOS transistor 410 is turned on. As a result, in the channel driving circuit 330-2, the potential of the output signal DP2 rises to the VAAP voltage level. Consequently, the partition walls 28*a* and 28*b* on both the sides of the ink chamber 22 are respectively deformed to the outer sides to expand the volume of the ink chamber 22. The ink is filled in the ink chamber 22.

An induced voltage −Vup in a minus direction is generated in the electrode 19 on the channel ch.2 side twice at point T1 and point T2. At point T1, the PMOS transistor 430 and the NMOS transistor 440 in the channel driving circuit 330-1 are turned on. At point T2, the NMOS transistor 470 in the channel driving circuit 330-1 is turned on.

At this point, in this embodiment, first, the high-impedance PMOS transistor 430 and the high-impedance NMOS transistor 440 are turned on. After the elapse of the predetermined time, the low-impedance NMOS transistor 470 is turned on. Therefore, a peak value of the induced voltage −Vup is suppressed.

An induced voltage Vup in a plus direction is generated in the electrode 19 on the channel ch.1 side twice at point T4 and point T5. At point T4, the PMOS transistor 430 and the NMOS transistor 440 in the channel driving circuit 330-2 are turned on. At point T5, the PMOS transistor 410 in the channel driving circuit 330-2 is turned on.

At this point, in this embodiment, first, the high-impedance PMOS transistor 430 and the high-impedance NMOS transistor 440 are turned on. After the elapse of the predetermined time, the low-impedance PMOS transistor 410 is turned on. Therefore, a peak value of the induced voltage Vup is suppressed.

At point T6, the logic unit 310 outputs the control signal LVC for turning on the NMOS transistor 460 of the load-voltage generating circuit 340. According to the control signal LVC, in the load-voltage generating circuit 340, the NMOS transistor 460 is turned on and the PMOS transistor 450 is turned off. As a result, the signal LV changes to the GND level.

At point T7, the logic unit 310 outputs the driving signal DR1 for turning on both the high-impedance PMOS transistor 430 and the high-impedance NMOS transistor 440 of the channel driving circuit 330-1. According to the driving signal DR1, in the channel driving circuit 330-1, the NMOS transistor 470 is turned off and the PMOS transistor 430 and the NMOS transistor 440 are turned on. As a result, the channel driving circuit 330-1 selects the signal LV at the GND level. Therefore, the potential of the output signal DP1 of the channel driving circuit 330-1 starts to rise.

At point T8 after the elapse of a predetermined time from point T7, the logic unit 310 outputs the driving signal DR1 for turning on the low-impedance NMOS transistor 420 of the channel driving circuit 330-1. According to the driving signal DR1, in the channel driving circuit 330-1, the PMOS transistor 430 and the NMOS transistor 440 are turned off and the NMOS transistor 420 is turned on again. As a result, in the channel driving circuit 330-1, the potential of the output signal DP1 returns to the GND level.

At point T9 after the elapse of a predetermined time from point T8, the logic unit 310 outputs the driving signal DR2 for turning on both of the high-impedance PMOS transistor 430 and the high-impedance NMOS transistor 440 of the channel driving circuit 330-2. According to the driving signal DR2, in the channel driving circuit 330-2, the PMOS transistor 410 is turned off and the PMOS transistor 430 and the NMOS transistor 440 are turned on. As a result, the channel driving circuit 330-2 selects the signal LV at the GND level. Therefore, the potential of the output signal DP2 of the channel driving circuit 330-2 starts to drop.

At point T10 after the elapse of a predetermined time from point T9, the logic unit 310 outputs the driving signal DR2 for turning on the low-impedance NMOS transistor 420 of the channel driving circuit 330-2. According to the driving signal DR2, in the channel driving circuit 330-2, both of the PMOS transistor 430 and the NMOS transistor 440 are turned off and the NMOS transistor 420 is turned on. As a result, in the channel driving circuit 330-2, the potential of the output signal DP2 returns to the GND level. Consequently, the ink chamber 22 of the channel ch.1 filled with the ink is restored to the regular state and ink droplets are ejected from the nozzle 23 corresponding to the ink chamber 22.

The induced voltage Vup in the plus direction is generated in the electrode 19 on the channel ch.2 side twice at point T7 and point T8. At point T7, the PMOS transistor 430 and the NMOS transistor 440 in the channel driving circuit 330-1 are turned on. At point T8, the NMOS transistor 420 in the channel driving circuit 330-1 is turned on.

At this point, in this embodiment, first, the high-impedance PMOS transistor 430 and the high-impedance NMOS transistor 440 are turned on. Then, after the elapse of the predetermined time, the low-impedance NMOS transistor 420 is turned on. Therefore, the peak value of the induced voltage Vup can be suppressed.

The induced voltage −Vup in the minus direction is generated in the electrode 19 on the channel ch.1 side twice at point T0 and point T10. At point T9, the PMOS transistor 430 and the NMOS transistor 440 in the channel driving circuit 330-2 are turned on. At point T10, the NMOS transistor 420 in the channel driving circuit 330-2 is turned on.

At this point, in this embodiment, first, the high-impedance PMOS transistor 430 and the high-impedance NMOS transistor 440 are turned on. Then, after the elapse of the predetermined time, the low-impedance NMOS transistor 420 is turned on. Therefore, the peak value of the induced voltage −Vup is suppressed.

At point T11, the logic unit 310 outputs the control signal LVC for turning on the NMOS transistor 480 of the load-voltage generating circuit 340. According to the control signal LVC, in the load-voltage generating circuit 340, the NMOS transistor 460 is turned off and the NMOS transistor 480 is turned on. As a result, the signal LV changes to the VAAN voltage level.

At point T12, the logic unit 310 outputs the driving signal DR2 for turning on both of the high-impedance PMOS transistor 430 and the high-impedance NMOS transistor 440 of the channel driving circuit 330-2. According to the driving signal DR2, in the channel driving circuit 330-2, the NMOS transistor 420 is turned off and the PMOS transistor 430 and the NMOS transistor 440 are turned on. As a result, the channel driving circuit 330-2 selects the signal LV at the VAAN voltage level. Therefore, the potential of the output signal DP2 of the channel driving circuit 330-2 starts to drop.

At point T13 after the elapse of a predetermined time from the point T12, the logic unit 310 outputs the driving signal DR2 for turning on the low-impedance NMOS transistor 470 of the channel driving circuit 330-2. According to the driving signal DR2, in the channel driving circuit 330-2, the PMOS transistor 430 and the NMOS transistor 440 are turned off and the NMOS transistor 470 is turned on. As a result, in the channel driving circuit 330-2, the potential of the output signal DP2 drops to the VAAN voltage level.

At point T14, the logic unit 310 outputs the control signal LVC for turning on the PMOS transistor 450 of the load-voltage generating circuit 340. According to the control signal LVC, in the load-voltage generating circuit 340, the NMOS transistor 480 is turned off and the PMOS transistor 450 is turned on. As a result, the signal LV changes to the VAAP voltage level.

At point T15, the logic unit 310 outputs the driving signal DR1 for turning on both the high-impedance PMOS transistor 430 and the high-impedance NMOS transistor 440 of the channel driving circuit 330-1. According to the driving signal DR1, in the channel driving circuit 330-1, the NMOS transistor 420 is turned off and the PMOS transistor 430 and the NMOS transistor 440 are turned on. As a result, the channel driving circuit 330-1 selects the signal LV at the VAAP voltage level. Therefore, the potential of the output signal DP1 starts to rise.

At point T16 after the elapse of a predetermined time from point T15, the logic unit 310 outputs the driving signal DR1 for turning on the low-impedance PMOS transistor 410 of the channel driving circuit 330-1. According to the driving signal DR1, in the channel driving circuit 330-1, both of the PMOS transistor 430 and the NMOS transistor 440 are turned off and the PMOS transistor 410 is turned on. As a result, in the channel driving circuit 330-1, the potential of the output signal DP1 rises to the VAAP voltage level. Consequently, the volume of the ink chamber 22 of the channel ch.1 from which the ink droplets are ejected is reduced. A sudden voltage drop that occurs in the ink chamber 22 because of the ejection of the ink droplets is relaxed.

The induced voltage −Vup in the minus direction is generated in the electrode 19 on the channel ch.1 side twice at point T12 and point T13. At point T12, the PMOS transistor 430 and the NMOS transistor 440 in the channel driving circuit 330-2 are turned on. At point T13, the NMOS transistor 470 in the channel driving circuit 330-2 is turned on.

At this point, in this embodiment, first, the high-impedance PMOS transistor 430 and the high-impedance NMOS transistor 440 are turned on. Then, after the elapse of the predetermined time, the low-impedance NMOS transistor 470 is turned on. Therefore, the peak value of the induced voltage −Vup is suppressed.

The induced voltage Vup in the plus direction is generated in the electrode 19 on the channel ch.2 side twice when the PMOS transistor 430 and the NMOS transistor 440 in the channel driving circuit 330-1 are turned on at point T15 and when the PMOS transistor 410 in the channel driving circuit 330-1 is turned on at point T16. However, in this embodiment, first, the high-impedance PMOS transistor 430 and the high-impedance NMOS transistor 440 are turned on. Then, after the elapse of the predetermined time, the low-impedance PMOS transistor 410 is turned on. Therefore, the peak value of the induced voltage Vup is suppressed.

At point T17, the logic unit 310 outputs the control signal LVC for turning on the NMOS transistor 460 of the load-voltage generating circuit 340. According to the control signal LVC, in the load-voltage generating circuit 340, the NMOS transistor 460 is turned on and the PMOS transistor 450 is turned off. As a result, the signal LV changes to the GND level.

At point T18, the logic unit 310 outputs the driving signal DR2 for turning on both the high-impedance PMOS transistor 430 and the high-impedance NMOS transistor 440 of the channel driving circuit 330-2. According to the driving signal DR2, in the channel driving circuit 330-2, the NMOS transistor 470 is turned off and the PMOS transistor 430 and the NMOS transistor 440 are turned on. As a result, the channel driving circuit 330-2 selects the signal LV at the GND level. Therefore, the potential of the output signal DP2 starts to rise.

At point T19 after the elapse of a predetermined time from point T18, the logic unit 310 outputs the driving signal DR2 for turning on the low-impedance NMOS transistor 420 of the channel driving circuit 330-2. According to the driving signal DR2, in the channel driving circuit 330-2, the PMOS transistor 430 and the NMOS transistor 440 are turned off and the NMOS transistor 420 is turned on again. As a result, in the channel driving circuit 330-2, the potential of the output signal DP2 returns to the GND level.

At point T20, the logic unit 31 outputs again the driving signal DR1 for turning on both of the high-impedance PMOS transistor 430 and the high-impedance NMOS transistor 440 of the channel driving circuit 330-1. According to the driving signal DR1, in the channel driving circuit 330-1, the PMOS transistor 410 is turned off and the PMOS transistor 430 and the NMOS transistor 440 are turned on again. As a result, the channel driving circuit 330-1 selects the signal LV at the GND level. Therefore, the potential of the output signal DP1 starts to drop.

At point T21 after the elapse of a predetermined time from point T20, the logic unit 310 outputs the driving signal DR1 for turning on the low-impedance NMOS transistor 420 of the channel driving circuit 330-1. According to the driving signal DR1, in the channel driving circuit 330-1, the PMOS transistor 430 and the NMOS transistor 440 are turned off and the NMOS transistor 420 is turned on. As a result, in the channel driving circuit 330-1, the potential of the output signal DP1 returns to the GND level. Consequently, the ink chamber 22 once reduced in volume is restored to the regular state.

The induced voltage Vup in the plus direction is generated in the electrode 19 on the channel ch.1 side twice at point T18 and point T19. At point T18, the PMOS transistor 430 and the NMOS transistor 440 in the channel driving circuit 330-2 are turned on. At point T19, the NMOS transistor 420 in the channel driving circuit 330-2 is turned on.

At this point, in this embodiment, first, the high-impedance PMOS transistor 430 and the high-impedance NMOS transistor 440 are turned on. Then, after the elapse of the predetermined time, the low-impedance NMOS transistor 420 is turned on. Therefore, the peak value of the induced voltage Vup can be suppressed.

The induced voltage −Vup in the minus direction is generated in the electrode 19 on the channel ch.2 side twice when the PMOS transistor 430 and the NMOS transistor 440 in the channel driving circuit 330-1 are turned on at point T20 and when the NMOS transistor 420 in the channel driving circuit 330-1 is turned on at point T21. However, in this embodiment, first, the high-impedance PMOS transistor 430 and the high-impedance NMOS transistor 440 are turned on. Then, after the elapse of the predetermined time, the low-impedance NMOS transistor 420 is turned on. Therefore, the peak value of the induced voltage −Vup is suppressed.

As explained above, in the second embodiment, as in the first embodiment, the peak value of the induced voltage generated in the electrode can be suppressed. When circuit integration of the inkjet head driving device 30B is considered, it is possible to reduce the size and reduce costs of an IC.

In the first embodiment, the inkjet head driving device 30A adapted to the two kinds of driving power supplies, i.e., the VAA power supply and the GND is illustrated. In the second embodiment, the inkjet head driving device 30B adapted to the three kinds of driving power supplies, i.e., the VAAP power supply, the VAAN power supply, and the GND is illustrated. The present invention can also be applied to an inkjet head driving device that operates with four or more kinds of driving power supplies.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An inkjet head driving device comprising:

a load-voltage generating circuit configured to select any one voltage out of a reference voltage and a driving voltage having potential other than the reference voltage and output the voltage; and a plurality of channel driving circuits respectively provided to correspond to a plurality of channels of an inkjet head, each of the channel driving circuits including a first input terminal to which the driving voltage is applied, a second input terminal to which the reference voltage is applied, a third input terminal to which the voltage output from the load-voltage generating circuit is applied, an output terminal from which the reference voltage or the driving voltage is output to the channel corresponding to the output terminal, a series circuit in which a first switching element and a second switching element are connected in series between the first input terminal and the second input terminal and a connection point of the first switching element and the second switching element is connected to the output terminal, and a parallel circuit in which a third switching element and a fourth switching element are connected in parallel between the third input terminal and the output terminal.

2. The device of claim 1, wherein the third switching element and the fourth switching element have high impedance compared with the first switching element and the second switching element.

3. The device of claim 1, wherein each of the channel driving circuits further includes:

a first level shifter configured to change a level of a driving signal supplied to the first switching element;

a second level shifter configured to change a level of a driving signal supplied to the second switching element; and a third level shifter configured to change a level of a driving signal supplied to the third switching element and the fourth switching element.

4. The device of claim 1, further comprising a logic unit configured to first output a driving signal for turning on the third switching element and the fourth switching element of the parallel circuit to the channel driving circuit corresponding to an ink ejection target channel and then output, when a predetermined time elapses, a driving signal for turning on the first switching element or the second switching element of the series circuit to the channel driving circuit.

5. The device of claim 4, wherein the third switching element and the fourth switching element have high impedance compared with the first switching element and the second switching element.

6. The device of claim 4, wherein each of the channel driving circuits further includes:

a first level shifter configured to change a level of the driving signal supplied to the first switching element;

a second level shifter configured to change a level of the driving signal supplied to the second switching element; and a third level shifter configured to change a level of the driving signal supplied to the third switching element and the fourth switching element.

7. The device of claim 4, wherein the logic unit is mounted on an IC of one chip together with the plurality of channel driving circuits and the load-voltage generating circuit.

8. An inkjet head driving device comprising:

a load-voltage generating circuit configured to select any one voltage out of a reference voltage, a first driving voltage having potential higher than the reference voltage, and a second driving voltage having potential lower than the reference voltage and output the voltage; and a plurality of channel driving circuits respectively provided to correspond to a plurality of channels of an inkjet head, each of the channel driving circuits including a first input terminal to which the first driving voltage is applied, a second input terminal to which the reference voltage is applied, a third input terminal to which the voltage output from the load-voltage generating circuit is applied, a fourth input terminal to which the second driving voltage is applied, an output terminal from which the reference voltage or the driving voltage is output to the channel corresponding to the output terminal, a first series circuit in which a first switching element and a second switching element are connected in series between the first input terminal and the second input terminal and a connection point of the first switching element and the second switching element is connected to the output terminal, a parallel circuit in which a third switching element and a fourth switching element are connected in parallel between the third input terminal and the output terminal, and a second series circuit in which a fifth switching element and the second switching element are connected in series between the first input terminal and the fourth input terminal and a connection point of the fifth switching element and the second switching element is connected to the output terminal.

9. The device of claim 8, wherein the third switching element and the fourth switching element have high impedance compared with the first switching element and the second switching element.

10. The device of claim 8, wherein each of the channel driving circuits further includes:

a first level shifter configured to change a level of a driving signal supplied to the first switching element;

a second level shifter configured to change a level of a driving signal supplied to the second switching element;

a third level shifter configured to change a level of a driving signal supplied to the third switching element and the fourth switching element; and a fourth level shifter configured to change a level of a driving signal supplied to the fifth switching element.

11. The device of claim 8, further comprising a logic unit configured to first output a driving signal for turning on the third switching element and the fourth switching element of the parallel circuit to the channel driving circuit corresponding to an ink ejection target channel and then output, when a predetermined time elapses, a driving signal for turning on the first switching element or the second switching element of the first series circuit or a driving signal for turning on the first switching element or the fifth switching element of the second series circuit to the channel driving circuit.

12. The device of claim 11, wherein the third switching element and the fourth switching element have high impedance compared with the first switching element and the second switching element.

13. The device of claim 11, wherein each of the channel driving circuits further includes:

a first level shifter configured to change a level of the driving signal supplied to the first switching element;

a second level shifter configured to change a level of the driving signal supplied to the second switching element;

a third level shifter configured to change a level of the driving signal supplied to the third switching element and the fourth switching element; and a fourth level shifter configured to change a level of the driving signal supplied to the fifth switching element.

14. The device of claim 11, wherein the logic unit is mounted on an IC of one chip together with the plurality of channel driving circuits and the load-voltage generating circuit.

* * * * *